US006111231A

United States Patent [19]

Corson et al.

[11] Patent Number: 6,111,231

[45] Date of Patent: Aug. 29, 2000

[54] TEMPERATURE CONTROL SYSTEM FOR AN ELECTRIC HEATING ELEMENT

[75] Inventors: David N. Corson, Tulsa; Mark A. Baker, Collinsville, both of Okla.; Steven B. Schrand, Cincinnati, Ohio

[73] Assignee: Whirlpool Corporation, Benton Harbor, Mich.

[21] Appl. No.: 09/257,956

[22] Filed: Feb. 26, 1999

[51] Int. Cl.[7] ..... H05B 1/02

[52] U.S. Cl. ..... 219/506; 219/412; 219/448; 219/483; 219/508; 337/363

[58] Field of Search ..... 219/483, 411–414, 219/364, 501, 508, 519, 487, 511–513, 448; 337/337, 333, 340, 338, 363, 383

[56] References Cited

U.S. PATENT DOCUMENTS

| | | | |
|---|---|---|---|
| 2,838,646 | 5/1958 | Welch . | |
| 4,052,591 | 10/1977 | Sekera, Jr. et al. . | |
| 4,110,600 | 8/1978 | Spotts et al. | 219/364 |
| 4,328,407 | 5/1982 | Chaggaris | 219/508 |
| 4,493,980 | 1/1985 | Payne et al. . | |
| 4,745,262 | 5/1988 | Larsen . | |
| 4,856,981 | 8/1989 | Flanagan . | |
| 4,994,652 | 2/1991 | Wolf et al. . | |
| 5,329,918 | 7/1994 | Di Bari . | |
| 5,494,027 | 2/1996 | Maughan . | |
| 5,565,123 | 10/1996 | Wolff . | |
| 5,575,638 | 11/1996 | Witham et al. . | |

*Primary Examiner*—Mark Paschall
*Attorney, Agent, or Firm*—Hill & Simpson

[57] ABSTRACT

A temperature control system for electric range surface heating elements including an infinite switch electrically coupled to a surface heating element and a second switch, which selectively couples 120 VAC or 240 VAC power across the infinite switch and heating element. Alternatively, the second switch selectively couples either the infinite switch or an electronic controller to a surface heating element, wherein the electronic controller has timing circuits for cycling power supplied to the surface heating element according to a preset timing scheme within the timing circuits.

12 Claims, 2 Drawing Sheets

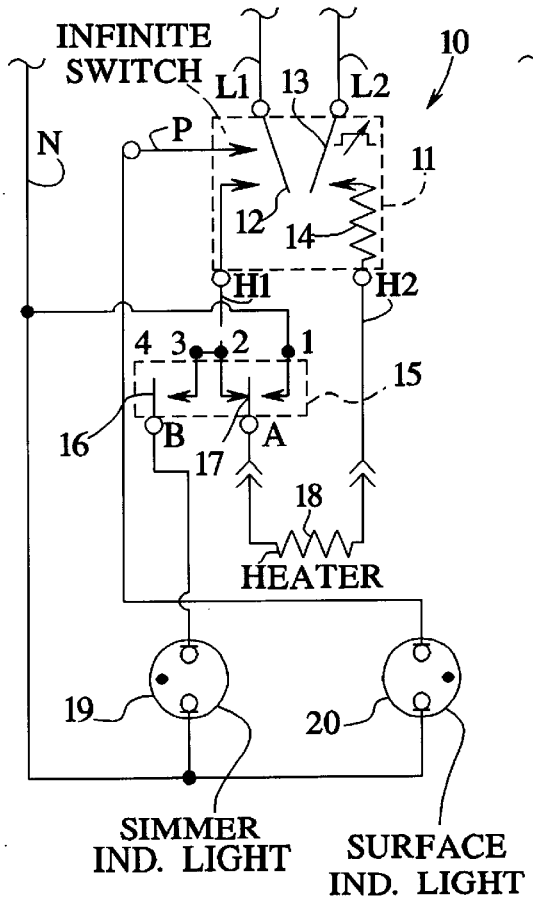
FIG. 1
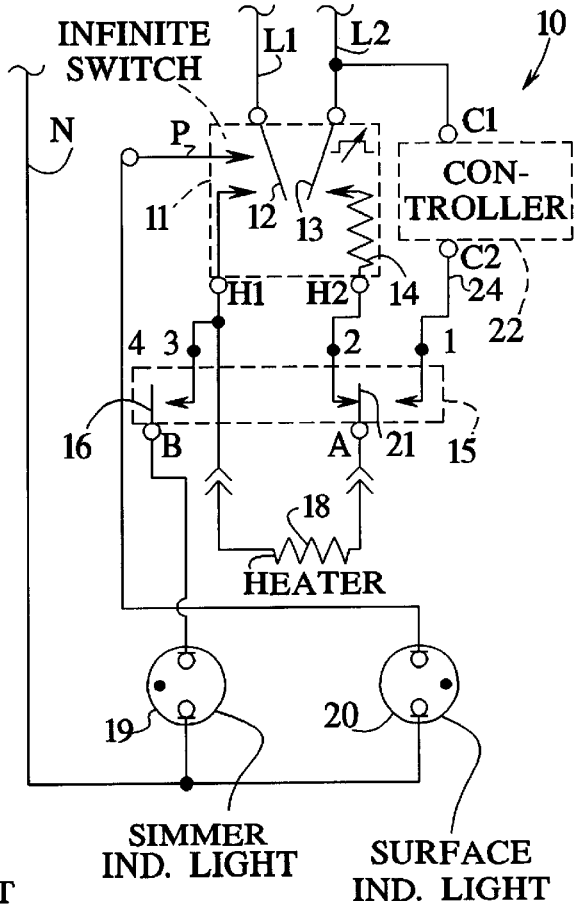
FIG. 2
FIG. 3
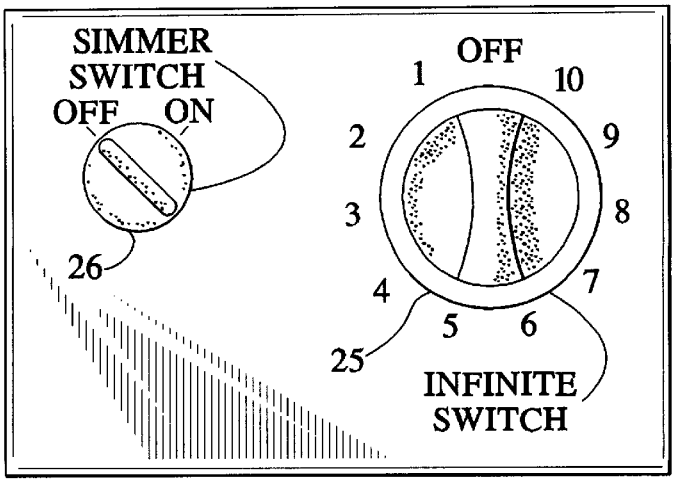

TEMPERATURE CONTROL SYSTEM FOR AN ELECTRIC HEATING ELEMENT

BACKGROUND OF THE INVENTION

The present invention generally relates to temperature control systems for electric range surface heating elements: Yet more particularly, the invention relates to a control for an electric range surface heating element at low power or simmer settings.

As is known, electric range heating elements are commonly used on cooktop surfaces. The heating elements are most commonly controlled by infinitely variable heat control switches, also known as infinite switches. Infinite switches regulate heating element temperature by intermittently interrupting the current supplied to the heating element for a frequency proportional to the infinite switch setting.

Infinite switches are generally designed for a sufficiently high, single voltage (240 VAC, for example) to provide sufficient output for maximum heat settings. Due in part to the mechanical constraints of the infinite switches, this results in inaccurate control at low power or simmer settings. Therefore, electric range surface elements which utilize infinite switch controls can vary from 1% to 10% input during a low power simmer setting. In some cases, a low power simmer setting cannot be maintained at all. Further, tolerance studies have revealed that infinite switches do not accurately maintain a simmer setting when operating within their tolerance specifications.

SUMMARY OF THE INVENTION

The present application provides improvements to control systems for electric range surface heating elements at low power or simmer settings. These improvements can be provided in a single all-encompassing unit or practiced separately.

To this end, in an embodiment, there is provided a control system comprising an infinite switch electrically coupled to a surface heating element and a second switch, which selectively couples 120 VAC or 240 VAC power across the infinite switch and heating element. As a result, the present invention provides substantially improved control of heater element input at low power or simmer settings by coupling 120 VAC power across the infinite switch and heater element.

In an embodiment, there is provided a control system connected to a three wire 240 VAC current source having a neutral line and two power lines of differing phases, wherein the second switch selectively couples the infinite switch and the heating element across the two power lines for 240 VAC power or across a neutral line and one of the two power lines for 120 VAC power.

In an embodiment, there is provided a control system comprising a second switch which selectively couples either an infinite switch or an electronic controller to a surface heating element, wherein the electronic controller has timing circuits for cycling power supplied to the surface heating element according to a preset timing scheme within the timing circuits. As a result, the present invention provides an electronic controller that is not subject to the mechanical constraints of an infinite switch and improves heater element temperature control at low power or simmer settings. Accordingly, the present invention provides substantially improved control over heater element temperature at low power or simmer settings than previously known temperature control systems.

These and other features of the invention will become clearer with reference to the following detailed description of the presently preferred embodiments and accompanied drawings.

BRIEF DESCRIPTION OF THE DRAWINGS

FIG. 1 illustrates a schematic of a temperature control system for an electric heating element embodying principles of the present invention.

FIG. 2 illustrates a schematic of a temperature control system for an electric heating element embodying principles of the present invention.

FIG. 3 is a front view of typical control knobs for a temperature control system for an electric heating element embodying principles of the present invention.

DETAILED DESCRIPTION OF THE PRESENTLY PREFERRED EMBODEMENTS

Figure 4:
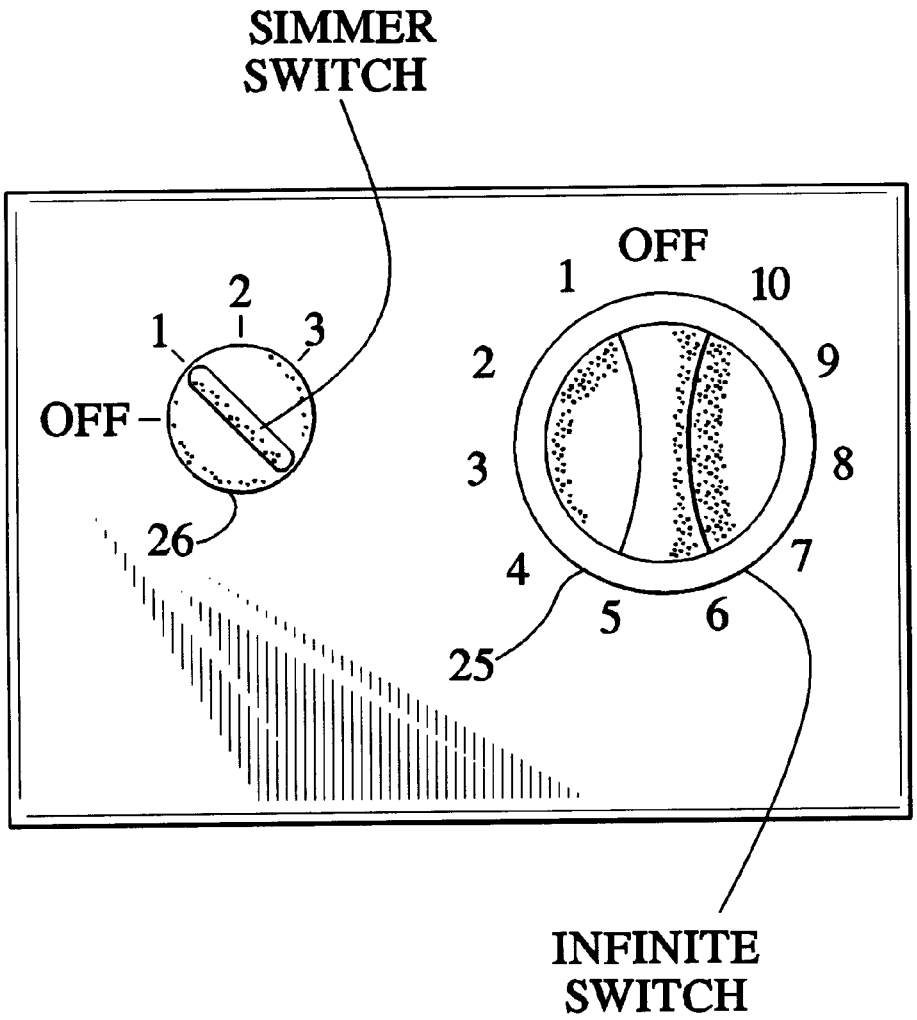
FIG. 4 is a front view of typical control knobs for a temperature control system for an electric heating element embodying principles of the present invention.

As discussed above, there is provided a control system for an electric range having a heating element including one or more features that, among other things, are particularly useful in accurately and consistently controlling heating element input at low power or simmer settings.

In FIG. 1, there is illustrated a temperature control system 10 that can embody principles of the invention. As illustrated, coupled between power lines L1 and L2 and neutral line N are an infinite switch 11, a second switch 15, a heater element 18, a simmer indicating light 19, and a surface indicating light 20. It will be understood that the voltage between power lines L1 and L2 will be twice that of the voltage between either power line L1 or L2 and neutral line N due to the phase difference between the two lines. Common voltage ratings are 240 volts between power lines L1 and L2 and 120 volts between either power line L1 or L2 and neutral line N.

The power lines L1 and L2 are connected to the infinite switch 11.

The heater 18 is connected between the infinite switch 11 through connection H2 and the second switch 15 via connection A.

The second switch 15 is coupled to connection H1 on the infinite switch 11 via connections 2 and 3 on the second switch. Additionally, the second switch 15 is connected to neutral line N via connection 1.

The simmer indicating light 19 is connected between neutral line N and the second switch 15 via connection B.

The surface indicating light 20 is connected between neutral line N and the infinite switch 11 via connection P.

Preferably the infinite switch 11 comprises a mechanical infinite switch as sold by Eaton Corporation. However, any infinite switch will do, such as that disclosed in U.S. Pat. No. 4,052,591. The infinite switch includes operating switch 12, timer switch 13, and resistor 14. Electric current is supplied to connections P and H1 on the infinite switch 11 through internal operating switch 12 being directly connected to power line L1. Electric current is supplied to connection H2 on the infinite switch 11 through internal resistor 14 and internal timer switch 13, which is directly connected to power line L2. The infinite switch is provided with a manually operated control knob 25 (FIG. 3) capable of 360° C. rotation.

The embodiment illustrated in FIG. 1 depicts the infinite switch 11 in the "OFF" position. To this end, operating switch 12 is set accordingly to its normally open position so as to disconnect supply power from power line L1 to heater element 18 via connections H1, 2 and A; to simmer indicating light 19 via connection H1, 3, and B; and to surface indicating light 20 via connection P. Timer switch 13 is set accordingly to its normally open position so as to disconnect supply power from power line L2 to heater 18 via resistor 14 and connection H2.

The second switch 15 is provided with a manually operated simmer control knob 26 (FIG. 3). In the preferred embodiment, the second switch 15 is a rotary switch and the simmer control knob 26 (FIG. 3) rotates to "ON" and "OFF" positions. In another embodiment, the second switch 15 is a four-position rotary switch and the simmer control knob 26 (FIG. 4) rotates to "1", "2", "3" and "OFF" positions. Alternatively, the simmer control knob 26 can be manually operated to a plurality of positions. The embodiment illustrated in FIG. 1 depicts the second switch 15 when the simmer control knob 26 (FIG. 3) is in the "OFF" position. The second switch 15 includes normally open contact 16 and normally closed contact 17. The second switch 15 is set accordingly with its normally open contact 16 open so as to disconnect supply power from line H1 to the simmer indicating light 19 via connections 3 and B while its normally closed contact 17 is closed to supply power from H1 to the heater element 18 via connections 2 and A. When the simmer control knob 26 (FIG. 3) is in the "ON" position, the second switch 15 is set accordingly with its normally open contact 16 closed so as to supply power from line H1 to the simmer indicating light 19 via connections 3 and B while its normally closed contact 17 is open to disconnect supply power from H1 to the heater element 18 via connections 2 and A and to connect supply power from neutral line N to the heater element 18 via connections 1 and A.

In operation, a user rotates the control knob 25 (FIG. 3) preferably counterclockwise from the "OFF" position to a desired heat setting, such that greater rotation from the "OFF" position results in a greater heat setting. Rotation from the "OFF" position actuates operating switch 12 and timer switch 13. To this end, operating switch 12 is accordingly closed supplying power to the surface indicating light 20 from power line L1 via connection P. Further, when the second switch 15 simmer control knob 26 (FIG. 3) is in the "OFF" position, power from power line L1 is supplied to the heater element 18 via connections H1, 2, and A.

As is known, the timer switch 13 will cycle supply power on and off from power line L2 to the heater element 18 to maintain a desired temperature. In this regard, upon counterclockwise rotation of control knob 25 (FIG. 3), the timer switch 13 will actuate for progressively longer time intervals, ranging from zero percent in the "OFF" position to a maximum percent of the total actuation time in the maximum heat position.

Due to mechanical constraints, infinite switches typically provide inaccurate temperature control or fail at low heat settings when power is supplied from a single high voltage source (240 VAC, for example). In order to accurately control heater elements at low power or simmer settings, it is desirable to operate the infinite switch at a voltage lower than that rated for high power operation.

In this regard, a feature of the invention to that end, is the overcoming of such infinite switch mechanical constraints at high voltage. In one embodiment, this problem is solved by permitting the user to toggle high and low voltage sources (240 VAC and 120 VAC, for example) across the infinite switch 11 and heater element 18 via the second switch 15.

When the simmer control knob 26 (FIG. 3) is in the "ON" position, the second switch 15 is set accordingly with its normally open contact 16 closed so as to supply power to the simmer indicating light 19. Further, the normally closed contact 17 opens, disconnecting high voltage power line L1 from the heater element 18 via connections H1, 2, and A and connects low voltage power lines L2 and N across the heater element 18 and infinite switch via connections H2, 1, and A. Thus, the timer switch 13 will continue to cycle supply power on and off from power line L2 to the heater element 18 to maintain a desired temperature, however, the power will return to neutral line N, resulting in low voltage power, instead of returning to high voltage power line L1. Therefore, in order to maintain a temperature at a particular level, the infinite switch knob 25 will need to be set at approximately twice the level as with the high power, thus moving the position of the infinite switch into a mechanically more reliable position. By inventively permitting the user to toggle high and low voltage sources (240 VAC and 120 VAC, for example) across the infinite switch 11 and heater element 18 via the second switch 15, the present invention provides more accurate temperature control of heater elements than previously achieved in the art.

Referring to FIG. 2, in an alternate embodiment of the invention, inaccurate temperature control at low power settings can be addressed by disabling the timer switch 13 at low power settings and enabling an electronic controller 22 to cycle power to the heater element 18 according to predetermined cycling ratios.

To this end, the electronic controller 22 is coupled between a power line L2, for example, via connection C1 and the second switch 15 via line 24 and connections C2 and 1.

The heater is connected between the infinite switch 11 through connection H1 and the second switch 15 via connection A.

The second switch 15 is coupled to connection H1 on the infinite switch 11 via connection 3. Additionally, the second switch 15 is coupled to connection H2 on the infinite switch 11 via connection 2.

The embodiment illustrated in FIG. 2 depicts the infinite switch 11 in the "OFF" position. To this end, operating switch 12 is set accordingly to its normally open position so as to disconnect supply power from power line L1 to heater element 18 via connection H1; to simmer indicating light 19 via connection H1, 3, and B; and to surface indicating light 20 via connection P. Timer switch 13 is set accordingly to its normally open position so as to disconnect supply power from power line L2 to heater 18 via resistor 14 and connections H2, 2, and A.

The embodiment illustrated in FIG. 2 again depicts the second switch 15 when the simmer control knob 26 (FIG. 3) is in the "OFF" position. The second switch 15 includes normally open contact 16 and normally closed contact 21. The second switch 15 is set accordingly with its normally open contact 16 open so as to disconnect supply power from line H1 to the simmer indicating light 19 via connections 3 and B while its normally closed contact 21 is closed to supply power from H2 to the heater element 18 via connections 2 and A. When the simmer control knob 26 (FIG. 3) is in the "ON" position, the second switch 15 is set accordingly with its normally open contact 16 closed so as to supply power from line H1 to the simmer indicating light 19 via connections 3 and B while its normally closed contact 21 is open to disconnect supply power from H2 to the heater element 18 via connections 2 and A and to connect supply power from line 24 to the heater element 18 via connections C2,1, and A.

In operation, rotating the control knob 25 (FIG. 3) from the "OFF" position actuates operating switch 12 and timer switch 13. Power supplied from power line L1 is coupled to heater element 18 via connection H1. When the second switch 15 is "OFF", the timer switch 13 will cycle supply power on and off from power line L2 to the heater element 18 to maintain a desired temperature.

When the simmer control knob 26 (FIG. 3) is in the "ON" position , the second switch 15 is set accordingly with its normally open contact 16 closed so as to supply power to the simmer indicating light 19. Further, the normally closed contact 21 opens, disconnecting the timer switch 13 from the heater element 18 via connections H2, 2, and A and connects the electronic controller 22 to the heater element 18 via line 24 at connections C2, 1, and A. Thus, the timer switch 13 is removed from the heater element 18 circuit. In its place, the electronic controller 22, will cycle supply power on and off from power line L2 to the heater element 18 to maintain a desired temperature. In the present embodiment, the heater element 18 and electronic controller 22 are coupled to high voltage power supplied from power lines L1 and L2 (240VAC, for example). In an alternate embodiment of the invention, the electronic controller 22 is coupled to neutral line N via connection C1 instead of to power line L2 via connection C1, wherein the heater element 18 and electronic controller 22 are coupled to the low voltage power supply (120 VAC, for example). As the timer switch 13 is removed from the heater element 18 circuit, the infinite switch 11 control knob 25 (FIG. 3) can be rotated to any position beyond the "OFF" position.

In the preferred embodiment, the electronic controller 22 has an electronic timer chip and a switching relay, wherein when the electronic timer chip cycles to a preset time, the switching relay activates to couple the heater element 18 to a power supply L1 or N. The electronic timer chip can be configured through a series of jumpers and/or resistors to cycle the switching relay on and off in an infinite number of combinations. The output of the electronic timer chip is tied directly to the coil of the switching relay coil, which activates the switching relay contacts. The switching relay contacts are electronically coupled in series with the power supply line L1 or N. During switching relay activation, the switching relay contacts carry the full current load of the heater element 18 being cycled. In an alternate embodiment of the invention, the electronic controller 22 is a programmable logic controller. Alternatively, the electronic controller 22 can be any form of electronic controller.

The timing circuits within the electronic controller 22 can be configured to cycle output power to the heater element 18 at preset intervals. Alternatively, the timing circuits within the electronic controller 22 can be user programmable through a plurality of methods, including switch settings and keypad entry.

In another embodiment, output from the second switch 15 is tied into the electronic controller 22. The second switch 15 is a four-position rotary switch and the simmer control knob 26 (FIG. 4) rotates to "OFF", "1", "2" and "3" positions, wherein "1" corresponds to low, "2" corresponds to medium, and "3" corresponds to high power simmer settings. Each position of the simmer control knob 26 (FIG. 4) selects a different preset cycling rate within the electronic controller 22, allowing the user to select a number of simmer settings. The preset cycling rates are configured in the electronic controller 22 using a series of jumpers and/or resistors. Preset cycling rates could be selected according to the setting on the simmer control knob 26 to cycle power to the heater element 18, for example, as follows:

low simmer=50 watts medium simmer=250 watts high simmer=450 watts

The preset cycling rates are modifiable to meet the user's needs. In operation, the electronic controller 22 cycles the heater element 18 at full rated voltage (240 VAC or 120 VAC). Thus, the preset cycling rates are not dependent on how much current is flowing to the heater element and do not vary with line voltage.

The foregoing eliminates the mechanical constraints and inaccurate control associated with low temperature settings in temperature control systems having infinite switches, by enabling the user to disable the infinite switch and enable an electronic controller 22, which provides more accurate temperature control at low power or simmer settings.

As is apparent from the foregoing specification, the invention is susceptible to being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A temperature control system for an electric range having a heating element, said control system comprising:

an infinite switch electrically coupled in series with said heating element; and a second switch manually positionable in a first position and a second position, said second switch electrically coupling two-phase alternating current power across said infinite switch and said heating element when in said first position and electrically coupling single-phase alternating current power across said infinite switch and said heating element when in said second position.

2. The control system for an electric range as claimed in claim 1, wherein said electric range is connected to a three wire 240 volt alternating current source, said three wires including a neutral line and two power lines of differing phases.

3. The control system for an electric range as claimed in claim 2, wherein when said second switch is in said first position, said infinite switch and said heating element are connected across said two power lines and when said second switch is in said second position, said infinite switch and said heating element are connected across said neutral line and one of said two power lines.

4. A temperature control system for an electric range having a heating element, said control system comprising:

an infinite switch operatively coupled in series with said heating element, said infinite switch having a thermostatic switch;

an electronic controller operatively coupled in series with said heating element, said electronic controller having timing circuits for cycling power supplied to said heating element according to a preset timing scheme within said timing circuits with said heating element operating at lower power than when power supplied to said heating element is regulated by said infinite switch; and a second switch operatively connected to mutually exclusively couple said infinite switch and said electronic controller to said heater element.

5. A temperature control system for an electric range having a heating element and three electrical lines, said control system comprising:

a first electrical line supplying electric power at a first phase;

a second electrical line supplying electric power at a second, different phase;

a neutral electric line;

at least one first switch capable of alternately supplying and disconnecting electric power therethrough in accordance with a setting thereof;

a second switch manually positionable in a first position and a second position, said second switch, when in said first position, electrically coupling said first electrical line and said second electrical line across a series connection of said first switch and said heating element and, when in said second position, electrically coupling one of said first electrical line and neutral electrical line across a series connection of said first switch and said heating element, and said first electrical line and other of said electrical lines across a series connection of a second of said first switches and said heating element.

6. A temperature control system according to claim 5, wherein said at least one first switch comprises an infinite switch.

7. A temperature control system according to claim 5, wherein said infinite switch is a sole first switch.

8. A temperature control system according to claim 5, wherein said at least one first switch comprises an infinite switch and an electronic control switch.

9. A temperature control system according to claim 5, wherein said electronic control switch comprises said second of said first switches.

10. A temperature control system according to claim 5, wherein said second of said first switches and said heating element have said first electrical line and said second electrical line coupled thereacross when said second switch is in said second position.

11. A temperature control system according to claim 5, wherein said second of said first switches and said heating element have said first electrical line and said neutral electrical line coupled thereacross when said second switch is in said second position.

12. A temperature control system according to claim 5, wherein said first and second electrical lines carry 120 volt alternating current, of differing phases.

* * * * *